US005786036A

United States Patent [19]

Pannenbecker et al.

[11] Patent Number: 5,786,036

[45] Date of Patent: Jul. 28, 1998

[54] BLOW-OFF APPARATUS

[76] Inventors: Heinrich Pannenbecker, Minnekenstege 73, 46569 Hünxe; Ronald Jabs, Am Domacker 93, 47447 Moers, both of Germany

[21] Appl. No.: 507,456

[22] PCT Filed: Feb. 25, 1994

[86] PCT No.: PCT/EP94/00560

§ 371 Date: Oct. 20, 1995

§ 102(e) Date: Oct. 20, 1995

[87] PCT Pub. No.: WO94/20647

PCT Pub. Date: Sep. 15, 1994

[30] Foreign Application Priority Data

Mar. 2, 1993 [DE] Germany ..... 43 06 394.2
Dec. 16, 1993 [DE] Germany ..... 43 42 904.1

[51] Int. Cl.[6] ..... B05D 3/04; B05C 11/06

[52] U.S. Cl. ..... 427/444; 427/8; 427/348; 427/349; 427/434.2; 427/435; 118/63; 118/672; 118/673; 118/712

[58] Field of Search ..... 427/8, 348, 349, 427/444, 435, 434.2; 118/712, 63, 672, 673

[56] References Cited

U.S. PATENT DOCUMENTS 4,078,103 3/1978 Thornton et al. ..... 427/349
5,614,266 3/1997 Cox et al. ..... 427/349

FOREIGN PATENT DOCUMENTS 0 188 813 2/1989 European Pat. Off. .
551 41556 5/1980 Japan .
413 6146 11/1992 Japan .

OTHER PUBLICATIONS

JP 62–30865 (Feb. 1987) (Abstract).

*Primary Examiner*—Katherine A. Bareford
*Attorney, Agent, or Firm*—Meltzer, Lippe, Goldstein, Wolf & Schliessel, P.C.

[57] ABSTRACT

The invention relates to an apparatus for blowing off surplus coating material in the continuous coating of a metal band, in particular in the zinc coating of steel bands, with a pair of blow-off nozzles, between whose nozzle bodies 2, which are chargeable with a blow-off medium, in particular compressed air, the metal band 1 is guided at a distance from the nozzle orifices 3 extending transversally to the running direction of the band. To improve the axial arrangement of the metal band between the nozzle bodies 2 it is provided that at least one of the two nozzle bodies 2 which are adjustable relative to the metal band carries an optical measuring device 4a, 4b which is movable parallel to the nozzle orifice 3 covering at least the zone of an edge K of the metal band 1 and that the opposing nozzle body is provided with a reflector 11 towards which the optical axis of the measuring device 4a, 4b is directed in its position outside of the metal band edge.

20 Claims, 7 Drawing Sheets

FIG. I

BLOW-OFF APPARATUS

This is a national stage application of International Application PCT/EP94/00560, filed Feb. 25, 1994.

BACKGROUND OF THE INVENTION

The invention relates to an apparatus and a method for blowing off surplus coating material in the continuous coating of a metal band, in particular in the zinc coating of steel bands, with a pair of blow-off nozzles, between whose nozzle bodies, which are chargeable with a blow-off medium, in particular compressed air, the metal band is guided at a distance from the nozzle orifices extending transversally to the running direction of the band.

In the continuous coating of metal bands, e.g. in zinc coating steel bands, the band is guided with roller guiding means from the coating material bath in such a way that it extends as axially as possible between the opposed stationary nozzle bodies of the blow-off nozzles which are each arranged on one side of the metal band. If this axial course is impaired, inhomogeneities of the pressure profile in the blow-off nozzles and accordingly uneven coating layers will occur.

An apparatus of the kind mentioned above is known from the European Patent 0 249 234. In this apparatus the nozzle orifice is formed by two mutually adjustable nozzle lips, so that the pressure of the blow-off medium exerted on the surface of the metal band is adjustable. Sensors are provided in this apparatus for measuring the layer thickness of the coating on the metal band. The sensors are connected with a computer whose output controls regulating valves. The quantity of the blow-off medium with which the nozzle orifice is charged can be varied with the regulating valves. In this way the coating thickness can be adjusted to the desired set value. If in this apparatus deviations occur in the course of the band from the axial position, then inhomogeneities will occur in the coating as a result of the uneven charging of the band surface with the blow-off medium along the band width.

Another apparatus of the kind mentioned above is known from WO 92/02656 in which the nozzle body is arranged as a nozzle strip, this being so in such a way that along the direction of the nozzle orifice there are provided several mutually sealed partial nozzles which can be separately charged with the blow-off medium. In this way it is possible to correct unevennesses of the band to be coated because the pressure conditions along the width of the nozzle orifice are variable owing to the division into partial nozzles.

The invention is based on the object of further developing an apparatus and a method of the kind mentioned above in such a way that the axial guidance of the metal band between the nozzle bodies is improved.

This object is achieved in respect of the apparatus in such a way that at least one of the two nozzle bodies adjustable relative to the metal band carries an optical measuring device which is movable parallel to the nozzle orifice over at least the zone of one edge of the metal band and that the opposed nozzle body is provided with a reflector towards which the optical axis of the measuring device is directed in its position outside of the edge of the metal band.

The invention is characterized in that it enables a precise measurement of the distance both with respect to the mutual distance between the nozzle bodies as well as the distance of one of the nozzle bodies to the metal surface facing it. The relevant aspect is that the optical measuring device comprises two distance ranges, namely the one within the width of the metal band and the one outside thereof. Whereas the distance between nozzle and band is determined within the edge of the metal band, the distance between the nozzles arises in the zone outside of the edge. As a result of these two measured signals it is possible that the positioning of the nozzle bodies can be made in such a way that both nozzle bodies can be moved to a defined distance with respect to the metal band, and in particular that both nozzle bodies can be arranged symmetrically with respect to the band.

In a preferred embodiment of the invention it is provided that downstream of the measuring device there is provided an evaluating device which allocates the measured signal to the current position on the axis of displacement and supplies it to a control loop for the adjusting device of at least one nozzle body. The evaluating device contains a discriminator for deciding between the measured signal reflected by the metal band and the one reflected by the reflector.

This leads to a possibility for automation in which the nozzle body (or nozzle bodies) is (are) adjusted through one or several adjusting devices according to the obtained measured signal in such a way that the best axial course of the band is obtained. Moreover, in this way it is possible to determine the precise position of the edge of the band and thus to achieve a symmetrization in this respect too, e.g. by using nozzles which are specially directed against the edges ("edge nozzles").

The reflector is preferably formed by a plane reflecting band extending parallel to the metal band whose width is selected in such a way that at least the edge positions of the band to be coated are covered. If bands of differing widths are to be coated then the reflecting band must have such a position that it extends in the transversal direction of the band from the zone of the narrowest over the edge of the widest band so that even in the widest metal band to be coated the measuring device facing the edge obtains a respective reflection signal. The positioning of the axis of rotation of the reflector leads to favourable adjusting possibilities. As not only the reflector has to be readjusted in a rotation of the nozzle body, but also the optical measuring device, it is preferably attached on the nozzle body carrying it in such away that an angular displacement can be compensated for by an equalizing screw provided for this purpose.

If the optical measuring device is arranged on a traverse towards which the associated nozzle body can be pivoted, the angular position of the measuring device towards the band is retained during the pivoting of the nozzle body so that an additional angular compensation can be omitted.

SUMMARY OF THE INVENTION

All modifications of the invention are preferably suitable for the combination with a common so-called two-roller or three-roller system in which the guidance of the band being guided out vertically from the coating material bath is carried out by the control of a guide roll. In accordance with the invention, the output signal of the evaluating device acts directly on the drive for the guide roll. As a result of this it is possible to compensate rough misadjustments already at this stage. As an alternative or simultaneously thereto it is possible to readjust the nozzle bodies too by means of the adjusting devices.

The simplest embodiment of the invention provides that two measuring devices are allocated to a nozzle body which are movable over non-overlapping zones of at least half the width of the metal band. It is possible that each measuring device may be drivable by a separate drive. In this embodiment each of the two measuring devices assumes the function of measuring the distance both within the edge of the band as well as outside of the edge of the band. During the coating each of the two measuring devices is moved by separate drives continuously parallel to the nozzle orifice, with measuring signals being obtained continuously or within certain intervals.

Another modification of the invention provides instead of the two individual measuring devices that the one nozzle body comprises two pairs of measuring devices with displacement zones which do not overlap, with the measuring devices of the first pair being movable over less than half the metal band width and the measuring device of the second pair covering the zone of the respective metal band edge. In this way the functions of the distance measurement of the nozzle to the band, the measurement of the metal band width and the distance measurement of nozzle to nozzle are transferred to separate measuring devices, with the first measuring devices for the measurement of nozzle to band always being moved in the zone of the band edge and the second pair of measuring devices always being moved in an oscillating way around the zone of the band edge and by separate drives.

Within this modification it is possible to provide alternatives in that either all measuring devices are arranged on a common guiding means and are drivable by separate drives or the measuring devices of the first and the second pair are arranged on different nozzle bodies, with the measuring devices which are movable around the zone of the metal band edge being arranged on the nozzle body opposite of the reflector (FIG. 4) and also each measuring device being displaceable by a separate drive. Both alternatives are technically equivalent, with the latter being easier to manufacture owing to non-overlapping drives.

A further modification of the invention provides that the optical measuring device is formed by a first measuring device which is arranged stationarily within the band edges and a pair of second measuring devices, of which each oscillates around a zone which includes the band edges adjacent to the respective measuring device.

This solution is particularly characterized in that three measured values are precisely available along the band width, from which it is adequately possible to deduce the presence of band faults such as faults in the band run or crowns of the band. At the same time the technological complexity of the apparatus is reduced because the first measuring device is arranged stationarily at a favourable position within the band edge zones. In contrast to this, only the two outer measuring devices, which form the pair of second measuring devices, must be arranged displaceably. A precise detection of the transition between metal band and edge is possible in such a way that the light beam of any measuring device can be widened by a predetermined aperture angle and that a receiver for detecting the intensity of the reflected light signal is provided.

The object on which the invention is based is achieved in a method for blowing off surplus coating material in the continuous coating of metal band, in particular during the zinc coating of steel band, in which the metal band passes through a coating material bath and reaches by means of guide and deflection rollers the zone of a pair of blow-off nozzles which can be charged with a blow-off medium, in particular compressed air, and are arranged above the bath surface, this being in such a way that an optical measuring device which is attached to at least one of the two nozzle bodies adjustable relative to the metal band is continuously moved transversally to the running direction of the band up to a point beyond the zone of one of the two band edges, with the measuring beam of the measuring device being reflected by the metal band surface in the zone within the band edge and by a reflector attached to the opposite nozzle body outside of the band edge.

It is preferably provided in this respect that the measured signal obtained within the band edge is used for correcting the respective distance between the nozzle orifice and the metal band surface and the measured signal obtained outside of the band edge is used for symmetrization of the distance of the each of the two nozzle orifices with respect to the metal band. From the position of the transition of the measured signal reflected from the metal band and the measured signal reflected by the reflector it is also possible to deduce the width of the metal band.

A preferred embodiment of the method provides a first measured signal is obtained by means of a stationary first measuring apparatus within the band edges and that a pair of second measured signals is obtained by means of of a pair of second measuring apparatuses which oscillate in the zone of the band edge.

The first measured signal is used for correcting the respective distance between nozzle orifice and metal band surface and the pair of second measured signals is used for the symmetrization of the distance of each of the two nozzle orifices in respect of the metal band. From the position of the transition of the measured signal reflected by the metal band and the one reflected by the reflector it is also possible to deduce the width of the metal band. The second measured signal measured within the band edge is also used for correcting the distance between nozzle orifice and band surface.

The invention is now explained in closer detail by reference to embodiments shown in drawings, wherein:

DETAILED DESCRIPTION OF THE INVENTION

Figure 1:
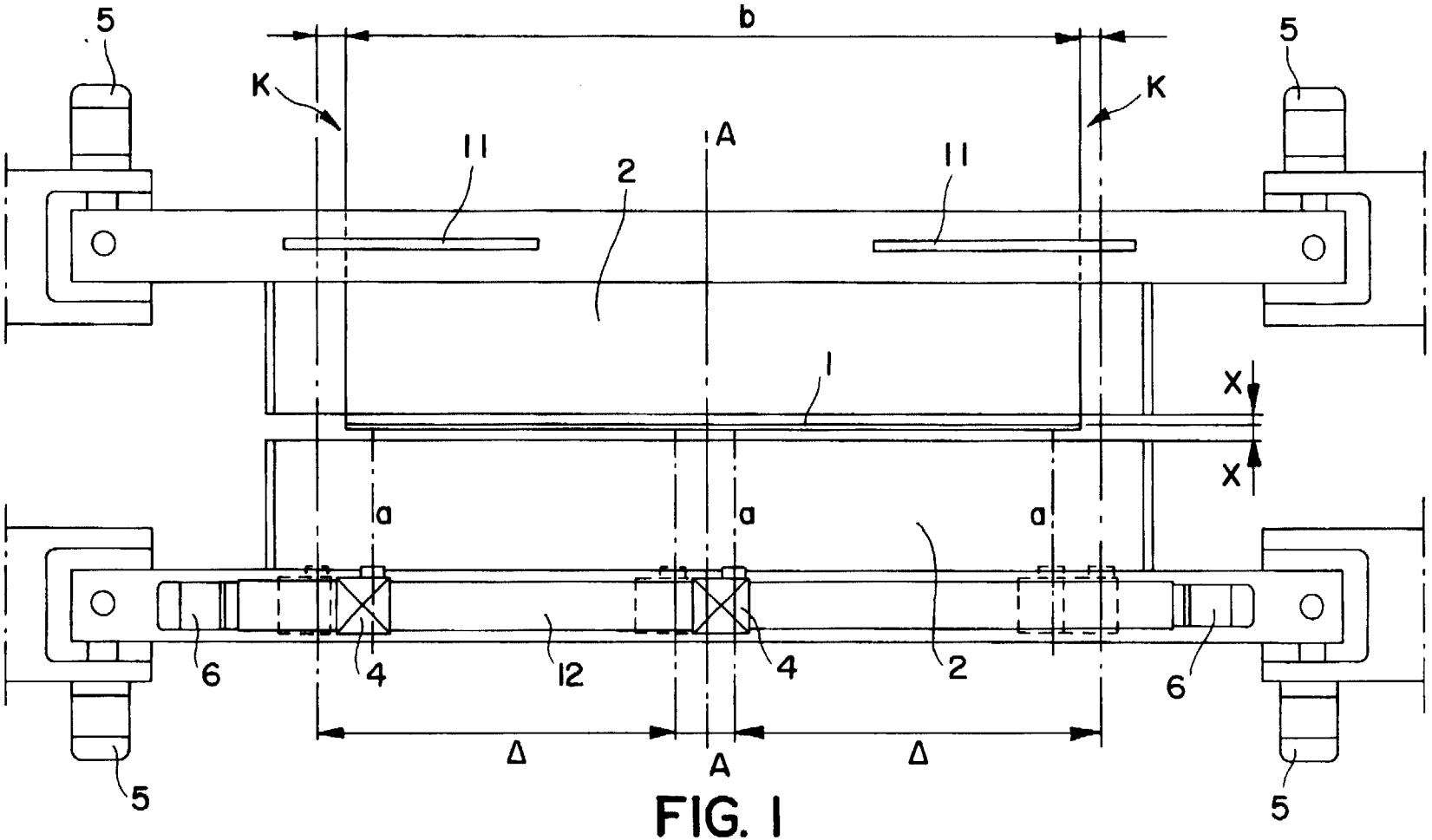
FIG. 1 shows a first embodiment of the invention in a top view in the normal plane of the metal band.
Figure 3:
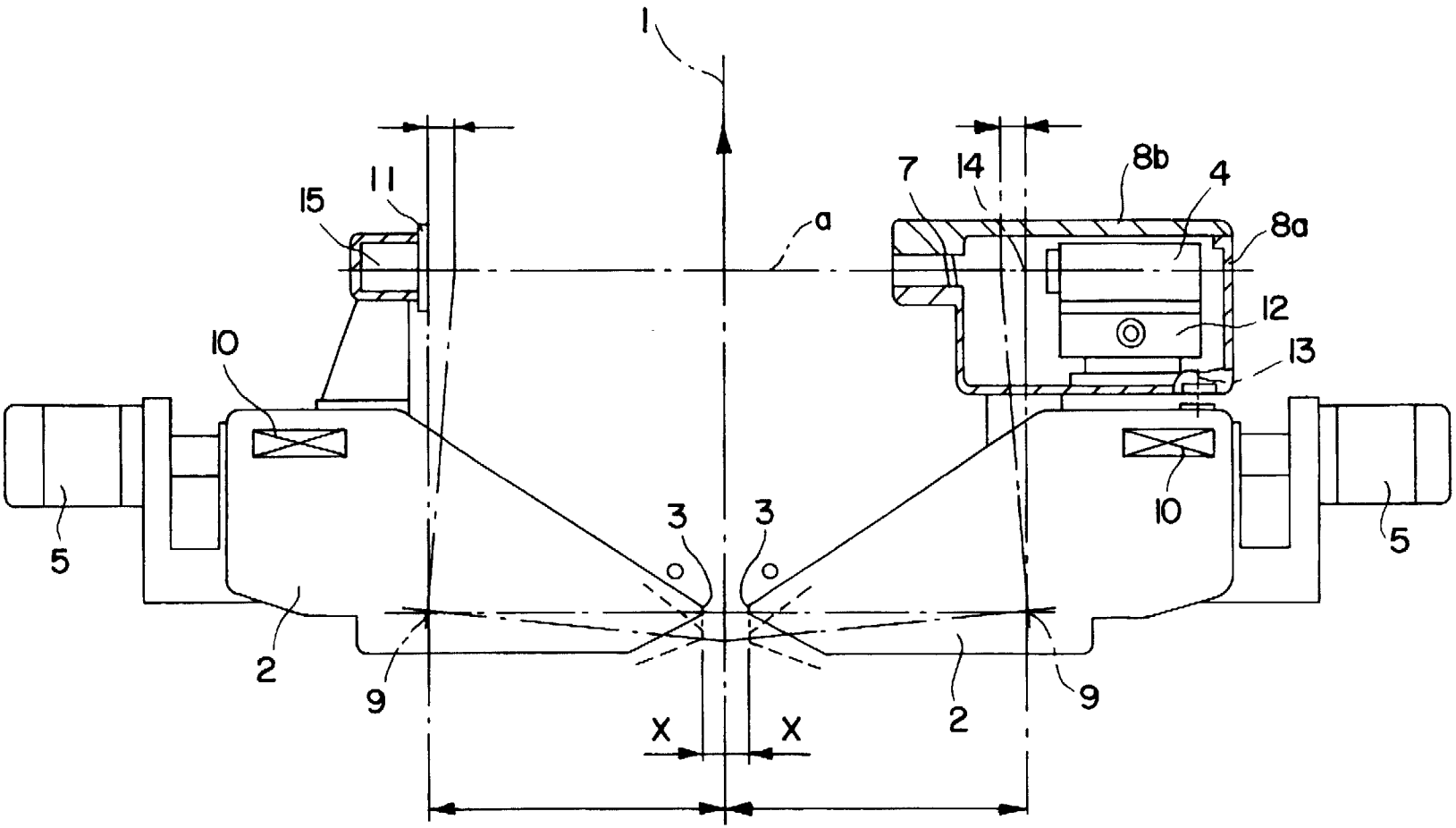
FIG. 3 shows a section along the line A—A in the FIG. 1

The first embodiment represented in FIG. 1 shows two nozzle bodies 2 which are provided on either side of the metal band 1 to be coated. The nozzle orifices of said bodies have a specific distance X from the surface of the metal band 1. The lower nozzle body 2, which is shown in FIG. 3 on the right side, carries on its surface a cap for a measuring device 4 which is arranged as an optical sensor which emits a laser beam along the optical axis designated with a. The beam impinges nearly vertically on the surface of metal band 1. The optical measuring device 4 is provided with a protective sleeve 7 which is charged with compressed air in order to prevent any soiling on the side where the light beam exits. The casing of measuring device 4 consists of a lid 8b and a rear casing part 8a which can be opened.

The optical measuring device 4 rests on a guiding means 12, on which it can be moved-alongside the width of the metal band 1 in the manner of a carriage.

The entire unit consisting of the guiding means 12, the measuring device 4 and casing 8*a*, 8*b* can be adjusted by means of an angle equalizing screw 13 by a certain angle of rotation with respect to the nozzle body 2 which carries the same. This is relevant when the nozzle body 2, which is rotatable about the pivot point 9, is adjusted and this angle is determined by the electronic angle detector 10.

Each of the two nozzle bodies 2 is movable by means of a drive 5 in the vertical direction to the conveying direction of the metal band 1 in the normal plane as represented in FIG. 1. For each nozzle body 2, however, the adjusting drive consists of two linear drives 5, towards which the nozzle body 2 is mounted on gimbals. In the event of even movement of its drives the nozzle body 2 is laterally adjustable towards the metal band and away from it, so that the distance between nozzle orifice 3 and the metal band surface is changeable.

In the event of opposite movement of the drives 5 the nozzle body 2 is rotatable in the normal plane as shown.

As is disclosed in FIG. 1, two optical measuring devices 4 are provided along the width b of the metal band which each cover approximately half of the metal band 1. They are continuously moved by separate drives 6 in such a way that they cover the area of movement as designated with Δ.

Reflectors 11 are provided on the opposite nozzle body 2 which cover the band edges designated with K.

The apparatus as represented in FIG. 1 operates as follows:

Each of the two measuring devices 4 is continuously moved along the guiding means 12, so that the measuring beam as designated with a of the respective measuring device 4 is reflected in the zone within the metal band edge K of metal band 1. If the measuring device 4 reaches the zone of metal band edge K, a sudden transition of the reflection occurs from metal band 1 to reflector 11. This sudden transition enables a precise recognition of the position of the band edge.

In the zone within the edges K the optical measuring device 4 measures the distance between the defined point on the nozzle body 2 and the metal band surface. If during the measurement within the path of movement within the metal band edges it is seen that the measured distance changes, then this allows concluding that there is an inclined position of the metal band with respect to the nozzle orifice. This can be counteracted by respective control of the drives or adjusting devices 5 or the guide rollers in the "two or three roller system".

If, on the other hand, the measuring device 4 determines a deviation of the measured value from the set value in the zone outside of the metal edges K, then this is caused by a change of the predetermined distance between the reference points of the two nozzle bodies 2. With the knowledge both of the distance between the reference points on the nozzle bodies 2 as well as the distance between a nozzle body and the metal band surface it is possible to carry out the symmetrization by means of an evaluating computer (not shown in detail) connected in outgoing circuit.

Figure 2:
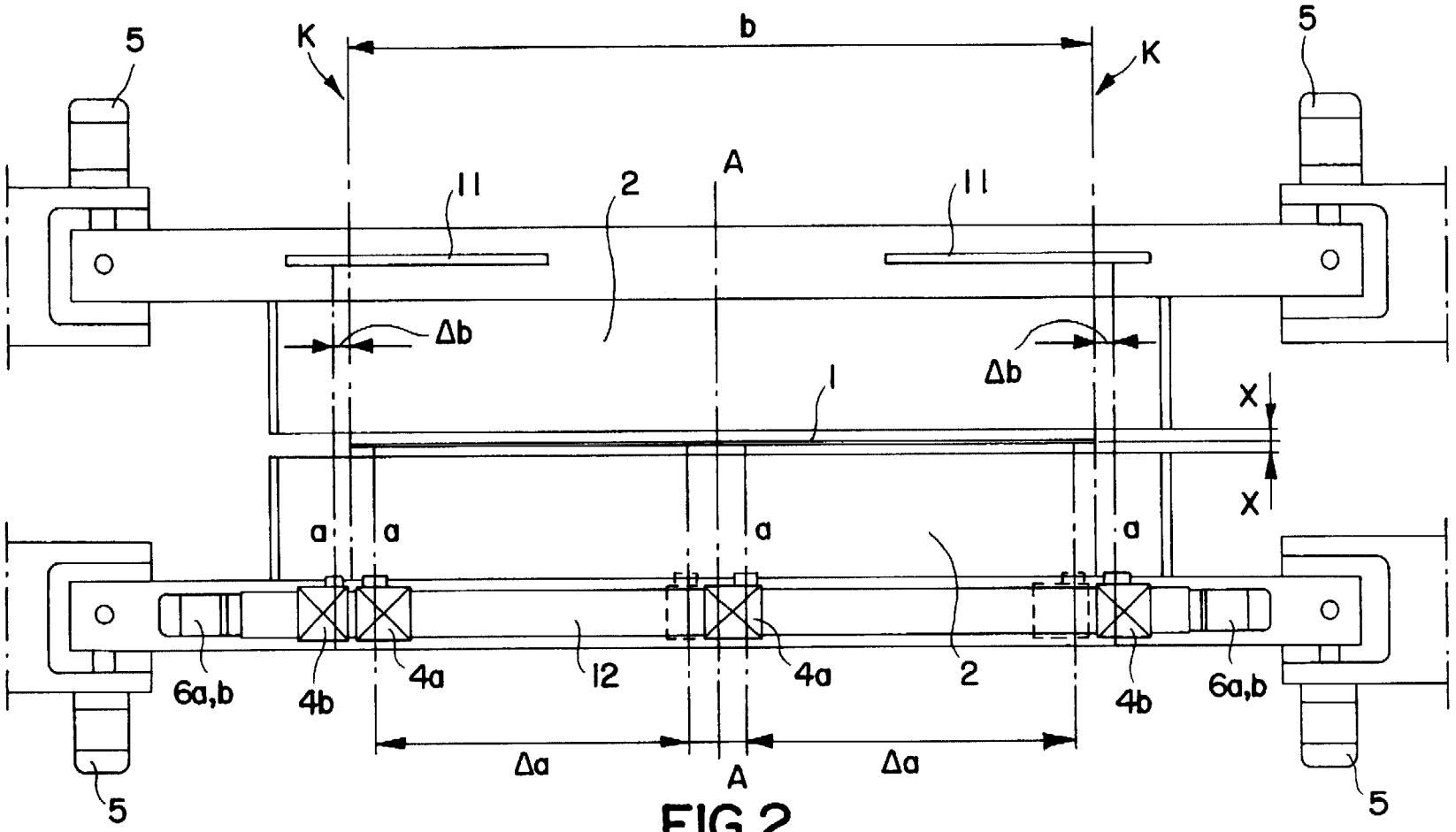
FIG. 2 shows a second embodiment of the invention.

The second embodiment of the invention as shown in FIG. 2 differs from the one shown above in that instead of two measuring devices which each cover more than half of the band there are four measuring devices, of which the two inner devices continuously oscillate in the movement zone as designated with Δa which lies within the band edges K. The two outer measuring devices 4*b*, however, oscillate within the zone as designated with Δb around the band edges K, with the measuring beam of the measuring devices 4*b* being reflected either by the metal band or by the reflectors 11. In this way it is possible to determine simultaneously the measured signals for the distance between nozzle body and band, between nozzle body and nozzle body and for the band width, thus allowing a faster evaluation.

FIG. 3 shows a section along line A—A of the embodiment shown in FIG. 1. The pivot points 14 and 15 for the optical measuring device 4 and the reflector 11, respectively, are shown in FIG. 3.

Figure 4:
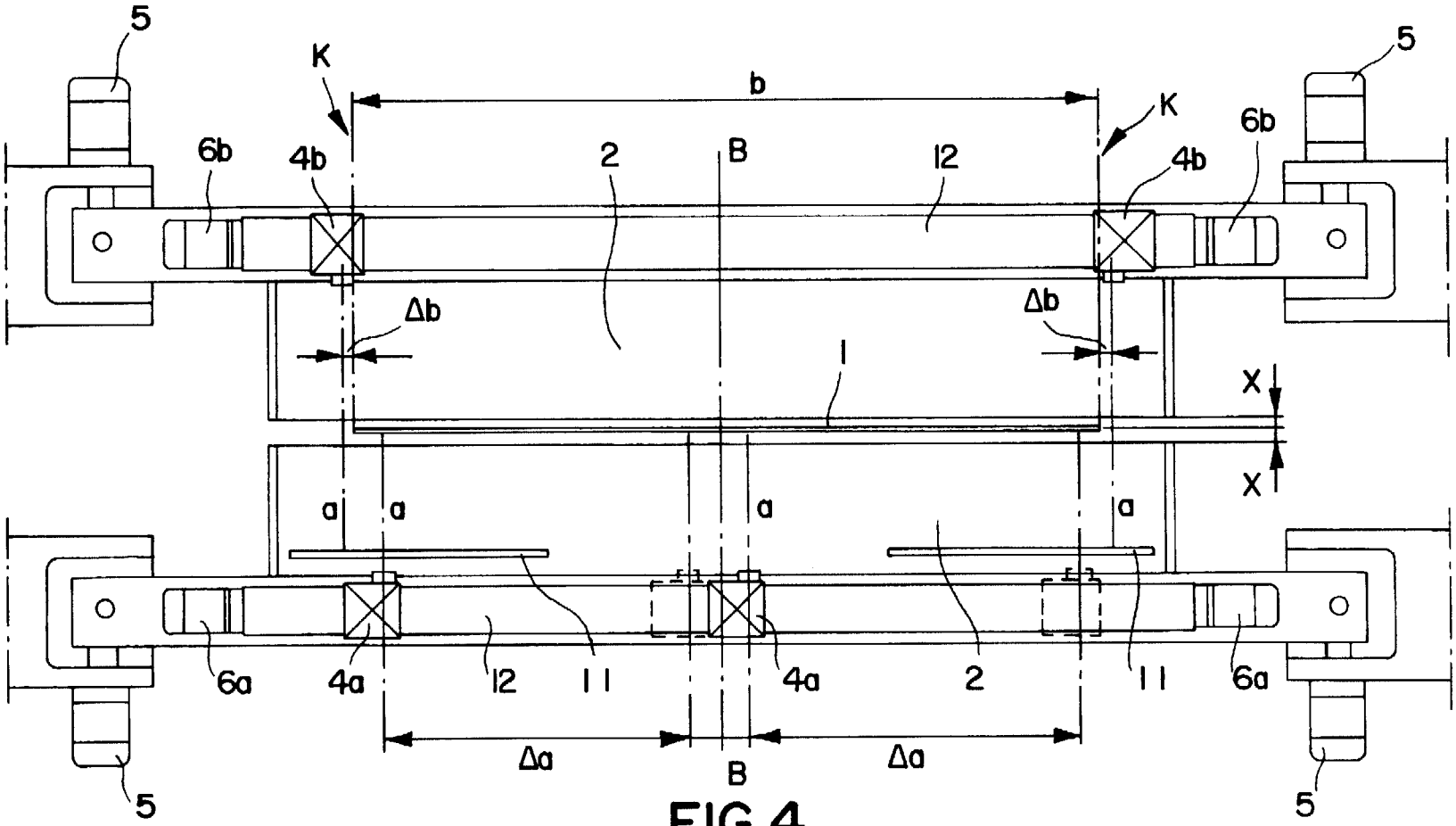
FIG. 4 shows a third embodiment of the invention in a top view in the normal plane of the metal band.
Figure 5:
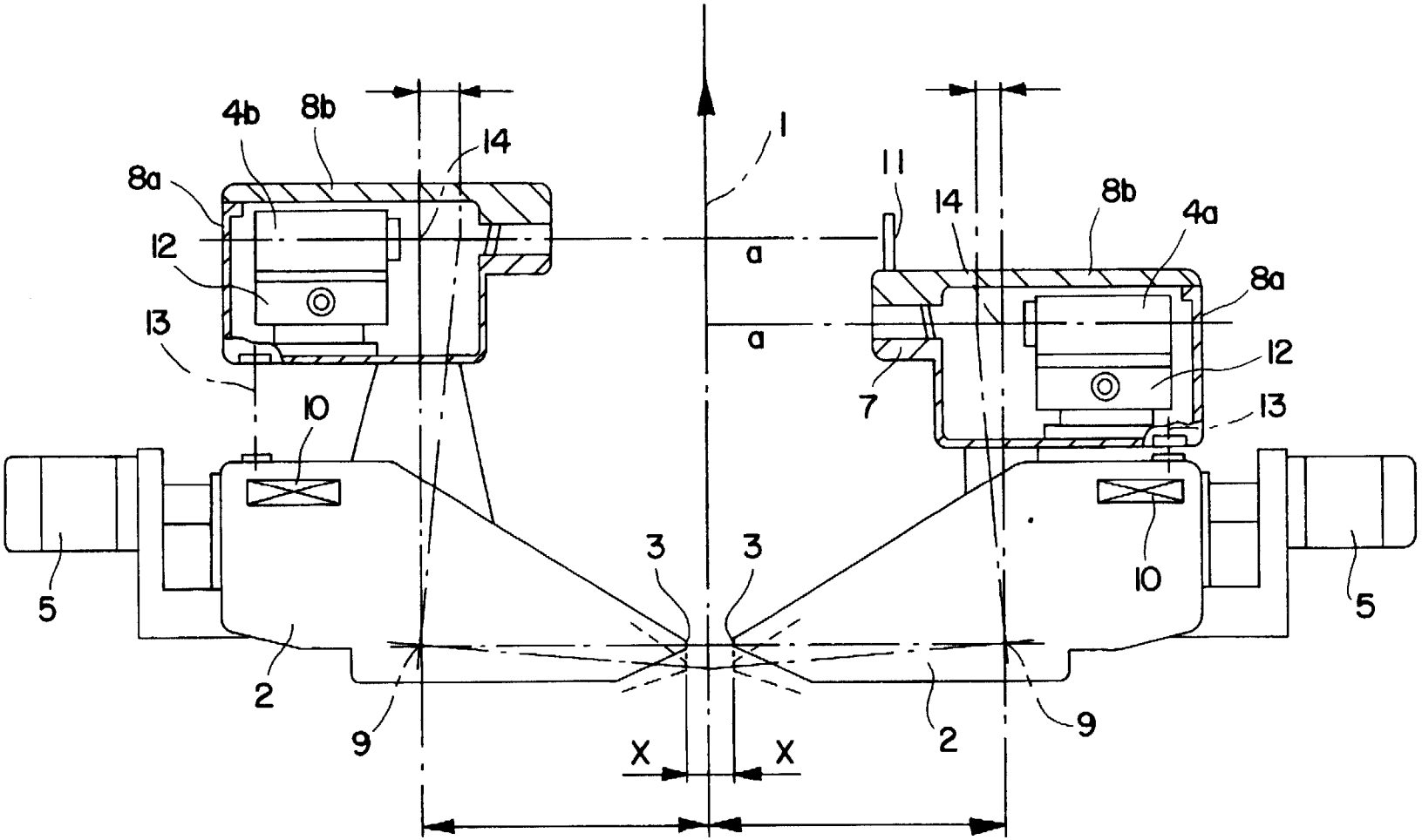
FIG. 5 shows a section along the line B—B in FIG. 4.

The embodiment shown in FIGS. 4 and 5 differs from the one shown in FIG. 2 only in the respect that the optical measuring devices 4*b* oscillating in the edge zone are not arranged on the joint guiding means 12 of the lower nozzle body, which also carries the measuring devices 4*a* facing the metal band. Instead, a further guiding means 12 is provided on the opposite (upper) nozzle body 2 for the optical measuring devices 4*b* facing the edge zones K. The reflector is accordingly provided on the nozzle body 2 which also carries the optical measuring devices 4*a*. The optical measuring devices 4*a*, 4*b* are driven by the drives 6*a*, 6*b*, respectively. The zones of movement Δa and Δb covered by the respective measuring devices are principally unchanged with respect to those of FIG. 2.

The embodiments shown in the FIGS. 2 and 4 offer advantages in the adjustment. If for technological reasons the band 1 is not to be blown off in the position as is shown in the unbroken lines, but in the position shown in the broken lines (FIG. 5), then it is necessary to rotate each nozzle body 2 about the pivot point 9. The rotation of the nozzle body 2 is determined by an electronic angle detection system 10. To ensure that the optical axis of each measuring device 4*a*, 4*b* continues to impinge vertically on the metal band 1 it is necessary to compensate the angular displacement, namely through an angle compensating screw 13. Such an angular correction can also be made electronically by using the measured signal of the angle detection system 10 for the position of the compensating screw 13.

Figure 6:
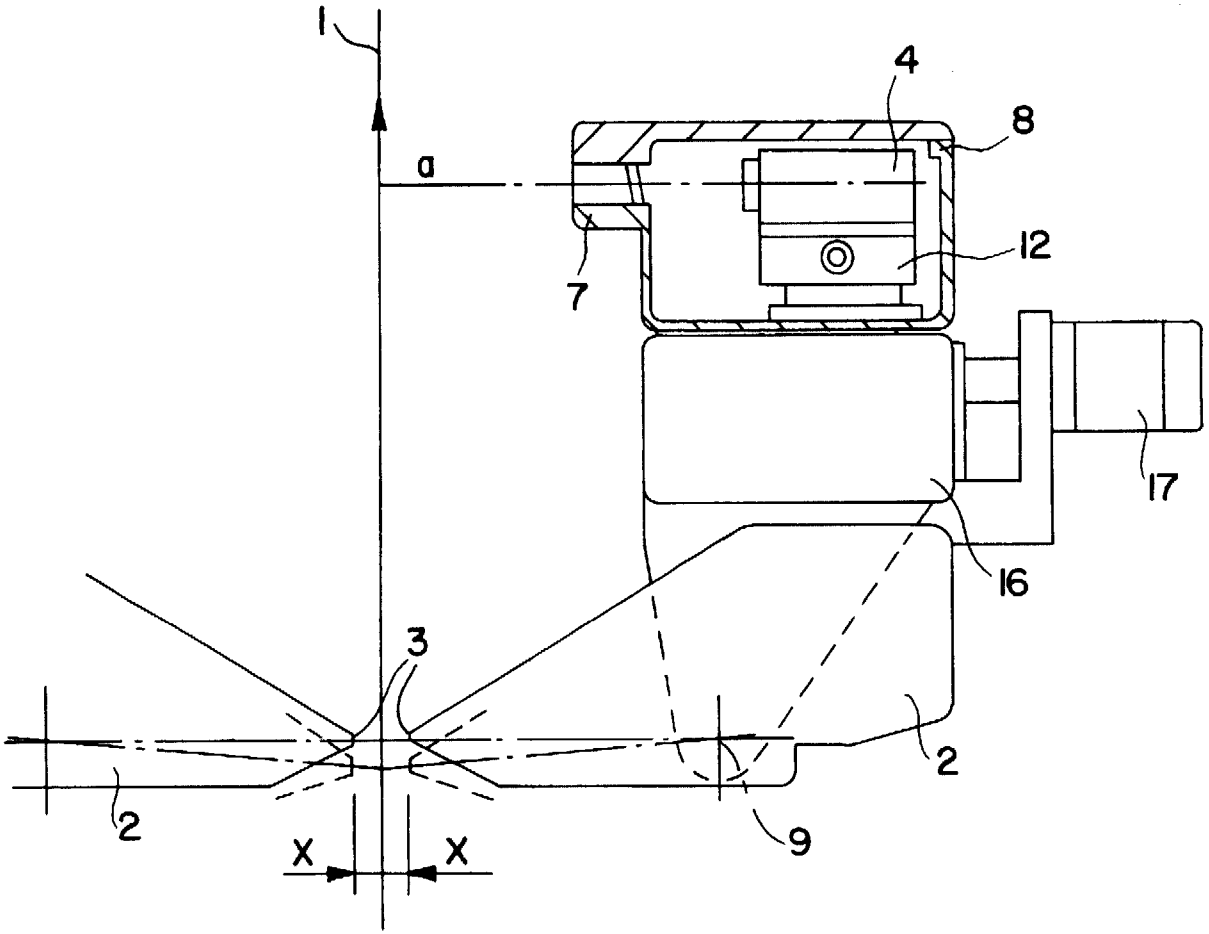
FIG. 6 shows a fourth embodiment of the invention in a sectional view.

The embodiment of the invention as shown in FIG. 6 shows an alternative to the arrangement as is shown in the respective right half of the images of FIGS. 3 and 5. According to these, the measuring device 4 does not rest directly on the nozzle body 2, but it is attached to a traverse 16, along which the measuring device is movable transversally to the course of the band. The traverse 16 is adjustable with respect to the metal band 1 by means of a traverse drive 17. The traverse 16 is held in the zone of the pivot point 9 for the nozzle body 2. The nozzle body 2 is rotatable with respect to traverse 16 in the pivot point 9, so that the traverse 16 and thus the measuring device 4 remain stationary during the rotation of the nozzle body 2 into the position as shown in broken lines in FIG. 6.

This means that the orientation of the measuring device 4 with respect to the metal band 1 is maintained also in the rotation of the nozzle body 2 about the pivot point 9. In this way it is possible to omit additional compensating means for equalizing the rotation.

Figure 7:
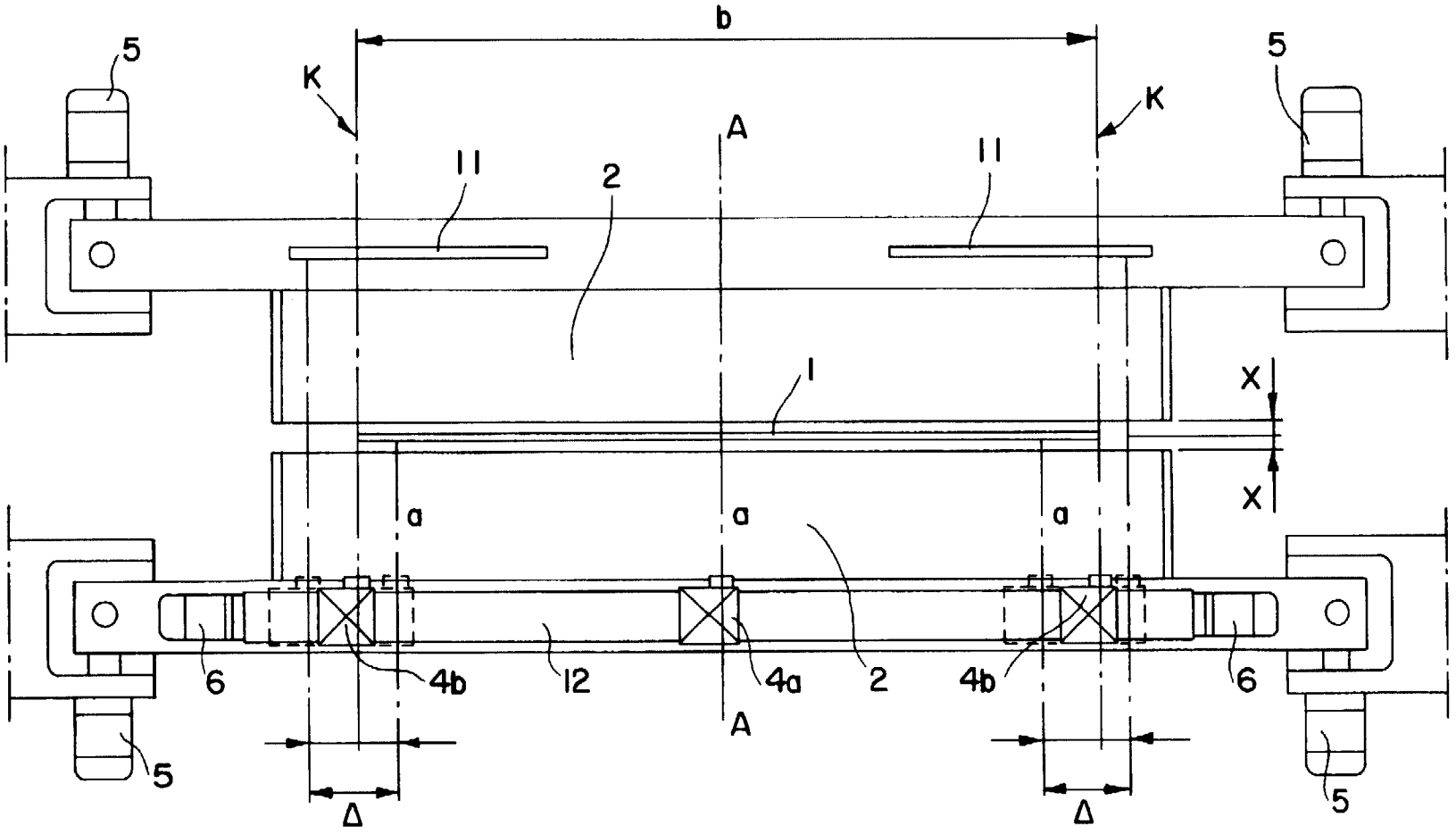
FIG. 7 shows a fifth embodiment of the invention again in a top view in the normal plane of the metal band.

The fifth embodiment shown in FIG. 7 differs from the embodiments as explained above in that one optical measuring device 4*b* is provided in each of the two edge zones of the metal band, which devices cover the illustrated zone Δ of the metal band 1, which includes the respective band edge. The measuring devices 4*b* are driven by separate drives 6 and are continuously movable in such a way that they cover the zone in an oscillating way. In contrast to this, the measuring device 4a provided in the central zone between the band edges is stationary.

The measuring devices 4a, 4b each rest on a guiding means 12, on which they are movable alongside the width of the metal band 1 either by means of the drives 6 (measuring devices 4b) or for setting the stationary position (measuring device 4a).

Reflectors 11 are provided on the opposite nozzle body 2 which cover the band edges.

This apparatus operates as follows:

Each of the two measuring devices 4b is continuously moved along the guiding means 12, oscillating around the zone Δ, in such a way that the measuring beam of the respective measuring device 4b which is designated with a is reflected in the zone within the metal band edge K by the metal band 1. If the measuring device 4b reaches the zone of metal band edge K, there is a sudden transition of the reflection from the metal band to the reflector 11. This sudden transition allows a precise recognition of the position of the band edge. This transition is detected particularly precisely because the measuring device 4b is provided with a light beam which is widened by a certain aperture angle. As a receiver is provided at the same time for detecting the intensity of the reflected beam, the transition can be determined precisely by the evaluation of specific intensity thresholds.

In the zone within the edges K the stationary measuring device 4a measures the distance between the defined point on the nozzle body 2 and the metal band surface. If in the course of the measurement the evaluation of the measured values obtained from the three measuring devices 4a, 4b shows an inclined position of the metal band with respect to the nozzle orifice, it is possible to carry out a compensation by respective control of the adjusting device 5 or the guide rollers in the "two or three roller system".

If, on the other hand, one of the measuring devices 4b determines a deviation of the measured value from a predetermined value outside of the metal band edges K, then this is caused by a change of the predetermined distance between the reference points of the two nozzle bodies 2. With the knowledge both of the distance between a nozzle body and the metal band surface it is possible to carry out a symmetrization by means of the evaluation computer (not shown in closer detail) provided in outgoing circuit.

We claim:

1. A method for blowing off surplus coating material from a metal band which has been coated in a bath during a continuous coating process, comprising guiding said metal band along a running direction between first and second mutually opposed nozzles which are charged with a blow-off medium, said nozzles comprising first and second nozzle bodies and first and second nozzle orifices, said metal band being guided between said first and second nozzle orifices which extend transversely to the running direction of the metal band;

emitting a light beam towards said metal band by a first optical measuring device which is mounted on said first nozzle body;

moving said first optical measuring device continuously along a zone of movement which is parallel to the first nozzle orifice, so that said light beam is reflected back to said first optical measuring device by said metal band when said first optical measuring device is within the outer edges of said metal band, and by a reflector mounted on said second nozzle body when said first optical measuring device moves beyond the outer edges of said metal band;

producing a first set of measured signals when said light beam is reflected back by said metal band and a second set of measured signals when said light beam is reflected back by said reflector; and adjusting the distance between said first nozzle orifice and said metal band based on said first set of measured signals, and adjusting the distance between said first nozzle orifice and said second nozzle orifice based on said second set of measured signals.

2. The method of claim 1, further comprising determining the width of said metal band based upon the position of said first optical measuring when a transition is made from said first set of measured signals and said second set of measured signals.

3. The method of claim 1 wherein said first set of measured signals is obtained by means of a stationary first optical measuring device located between the outer edges of said metal band, and said second set of measured signals is obtained from a pair of second optical measuring devices each of which oscillates in the zone of the outer edges of said metal band.

4. An apparatus for blowing off surplus coating material from a metal band in a continuous coating process, said apparatus comprising rollers which guide said metal band along a running direction;

first and second mutually opposed nozzles which are charged with a blow-off medium, said nozzles comprising first and second nozzle bodies and first and second nozzle orifices respectively, said metal band being guided by said rollers at a distance between said first and second nozzle orifices, said first and second nozzle orifices extending transversely to the running direction of said metal band;

at least a first adjusting device connected to said first nozzle body for adjusting the distance of said first nozzle orifice to said metal band;

at least a first optical measuring device mounted on said first nozzle body and emitting a light beam in the direction of said metal band, said first optical measuring device being movable parallel to said first nozzle orifice within a zone of movement which includes a region between the outer edges of said metal band and a region which extends beyond one of said outer edges;

a reflector mounted on said second nozzle body which extends beyond said outer edge of said metal band so that said light beam emitted by said first optical measuring device strikes said reflector when said first optical measuring device moves beyond said outer edge of said metal band;

said optical measuring device producing a first set of measured signals when said light beam is reflected back by said metal band and a second set of measured signals when said light beam is reflected back by said reflector; and an evaluating device connected to said first adjusting device and to said first optical measuring device, said evaluating device receiving said first and second sets of measured signals produced by said first optical measuring device, determining the distance between said first nozzle orifice and said metal band, and causing said first adjusting device to adjust the position of said first nozzle body based on said sets of measured signals, said evaluating device including a discriminator to distinguish between said first and second sets of measured signals.

5. The apparatus of claim 4 wherein said reflector comprises a reflector ribbon having a plane of reflection which extends parallel to said metal band and which extends beyond said outer edge of said metal band.

6. The apparatus of claim 5 wherein said second nozzle body is rotatable about a nozzle body pivot point, and said reflector ribbon is held by a carrier mounted rotatably on said second nozzle body, said plane of reflection of said reflector ribbon passing through said nozzle body pivot point.

7. The apparatus of claim 4 wherein said reflector is held by a casing which also carries said first optical measuring device.

8. The apparatus of claim 4 wherein said first nozzle body is swivellable about an axis parallel to said first nozzle orifice, and said first nozzle further includes an angle correction device for detecting the pivot angle of said first nozzle body, and an angle compensation screw for adjusting the angle of said first optical measuring device.

9. The apparatus of claim 4 wherein said first optical measuring device is an optical sensor by means of which the distance to the surface of said metal band or to said reflector is determined by the transit time of said light beam.

10. The apparatus of claim 4 wherein said light beam emitted by said first optical measuring device is a laser light beam.

11. The apparatus of claim 4 wherein said evaluating device is also connected to an adjusting drive connected to said rollers which guide said metal band along said running direction.

12. The apparatus of claim 4 wherein said first optical measuring device is mounted on a traverse, and further comprising a traverse drive for adjusting the position of said optical measuring device towards said metal band, said first nozzle body being swivellable towards said traverse.

13. The apparatus of claim 4 further comprising a second optical measuring device mounted on said first nozzle body, and first and second drives connected to said first and second optical measuring devices respectively for moving each of said first and second optical measuring devices.

14. The apparatus of claim 4 further comprising a second optical measuring device mounted on said first nozzle body, each of said first and second optical measuring devices being movable within first and second non-overlapping zones of movement, each of said first and second zones of movement including at least half the metal band width.

15. The apparatus of claim 4 wherein said first nozzle body is provided with first and second pairs of optical measuring devices having non-overlapping zones of movement, the optical measuring devices of said first pair of optical measuring devices having zones of movement covering less than half the metal band width, and the optical measuring devices of said second pair having zones of movement which extend beyond the outer edges of said metal band.

16. The apparatus of claim 15 wherein all of said optical measuring devices are mounted on a common guide, each of said optical measuring devices being driven by a separate drive.

17. The apparatus of claim 15 wherein said first and second pairs of optical measuring devices are mounted on different nozzle bodies, said optical measuring devices which move beyond the outer edges of said metal band being located on said nozzle body which is opposite to said reflector.

18. The apparatus of claim 17 wherein the light beam emitted by each of said measuring devices can be widened by a predetermined aperture angle, and wherein said apparatus further comprises a receiver which detects the intensity of a reflected light signal.

19. The apparatus of claim 4 wherein said first optical measuring device comprises a first measuring device which is non-movably mounted on said first nozzle body at a location which is between the outer edges of said metal band, and a pair of second measuring devices each of which oscillates around zones which include the outer edges of said metal band.

20. The apparatus of claim 19 wherein said pair of second measuring devices are mounted on a common guide.

* * * * *